United States Patent [19]

Bloomer

[11] 4,440,698

[45] Apr. 3, 1984

[54] APPARATUS FOR ENSURING HEAT EXCHANGE BETWEEN A GAS FLOW AND A HEAT EXCHANGER

[76] Inventor: Ivan Bloomer, 5 Deena Close, Queens Dr., London W3 OHR, England

[21] Appl. No.: 420,969

[22] Filed: Sep. 21, 1982

Related U.S. Application Data

[63] Continuation of Ser. No. 205,479, Nov. 10, 1980, abandoned.

[51] Int. Cl.[3] ..... B01F 3/04

[52] U.S. Cl. ..... 261/148; 62/314; 165/DIG. 11; 261/155; 261/116; 261/117; 261/43

[58] Field of Search ..... 261/148, 155, 100, 116, 261/117, 147, 153; 62/314; 165/DIG. 10, 165/DIG. 11, 96

[56] References Cited

U.S. PATENT DOCUMENTS

| | | | |
|---|---|---|---|
| 129,440 | 7/1872 | Turner | 261/148 |
| 889,201 | 6/1908 | Clark | 261/155 |
| 1,592,718 | 7/1926 | Browne | 62/314 |
| 1,777,843 | 10/1930 | Glisci | 62/314 |
| 2,065,358 | 12/1936 | Zarotschenzeff | 62/314 |
| 2,292,350 | 8/1942 | Brandt | 261/148 |
| 2,513,010 | 6/1950 | Deverall | 62/314 |
| 2,720,085 | 10/1955 | Boyle | 62/314 |
| 2,802,543 | 8/1957 | Clark | 261/100 |
| 3,212,424 | 10/1965 | Davis | 165/96 |
| 3,225,522 | 12/1965 | Black | 261/116 |
| 3,349,839 | 10/1967 | Priestley | 261/148 |
| 3,479,948 | 11/1969 | Mathews | 165/96 |
| 3,765,659 | 10/1973 | Reilly | 261/116 |
| 3,785,127 | 1/1974 | Mare | 261/100 |
| 3,785,625 | 1/1974 | Engalitcheff, Jr. | 261/116 |
| 4,196,157 | 4/1980 | Schinner | 261/155 |

FOREIGN PATENT DOCUMENTS

| | | | |
|---|---|---|---|
| 961421 | 6/1964 | United Kingdom | 261/148 |

*Primary Examiner*—Tim R. Miles
*Attorney, Agent, or Firm*—Krass and Young

[57] ABSTRACT

Apparatus for ensuring heat exchange between a gas flow and a heat exchanger comprises a duct through which the gas flows. The heat exchanger is mounted in the duct such that the gas flows therethrough. Constrictions for the gas flow are arranged in the duct upstream of the heat exchanger in the direction of gas flow such that jets of gas are created. In an embodiment the constrictions are provided by flow passages extending through a diaphragm mounted across the duct. In use, liquid is sprayed over the heat exchanger and the high velocity jets of gas pick up the liquid and carry it into the heat exchanger. In this way the surfaces of the heat exchanger are thoroughly wetted by the liquid and the efficiency of the heat transfer is thereby improved.

12 Claims, 20 Drawing Figures

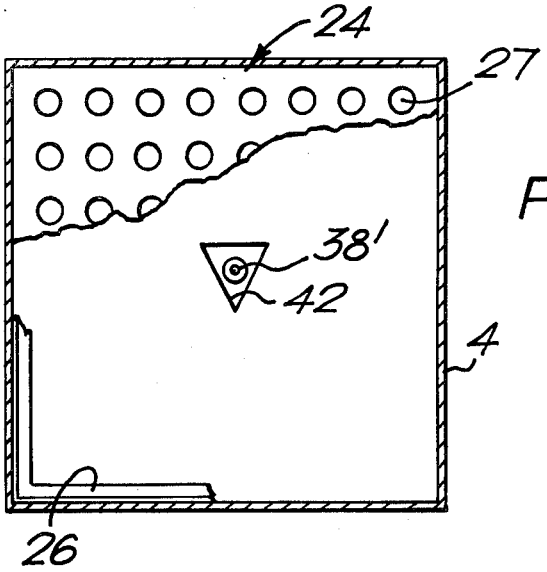
FIG.2.
FIG.3.
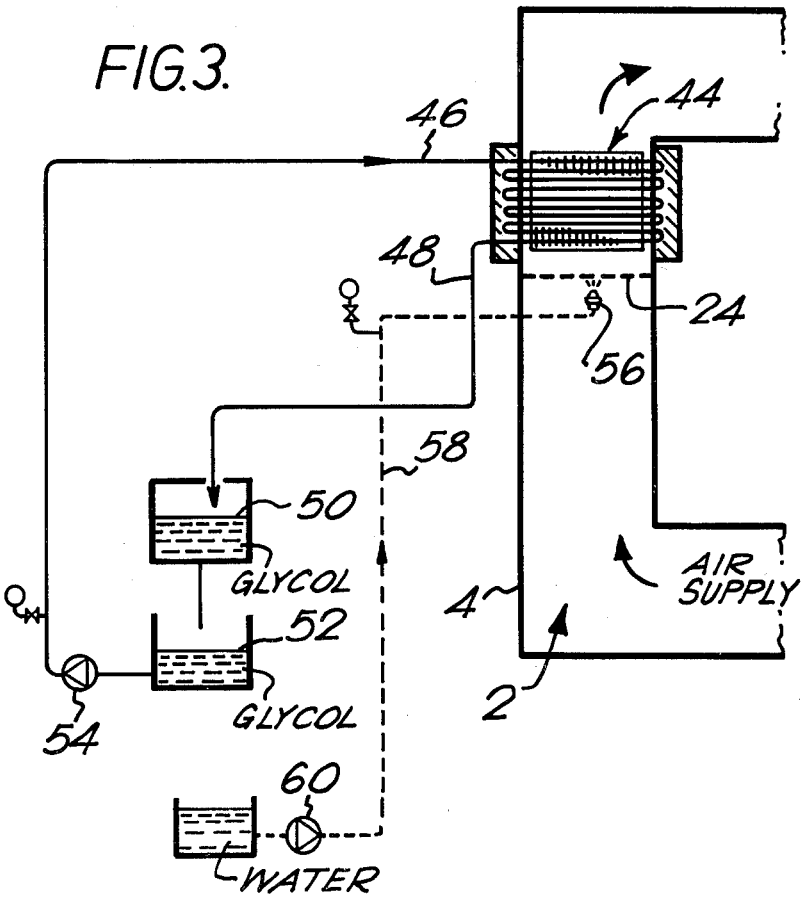

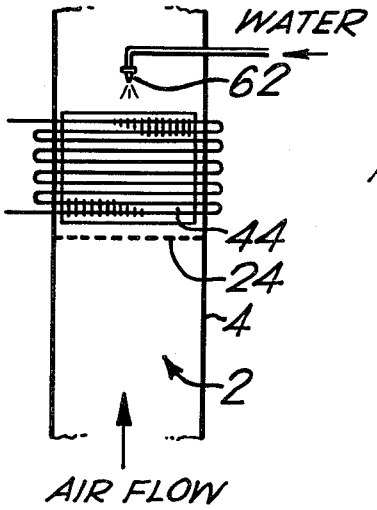
FIG.4.
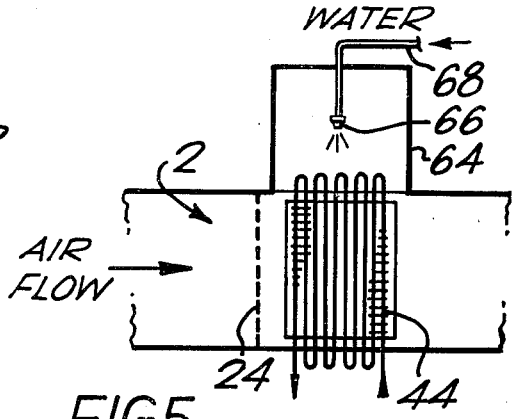
FIG.5.
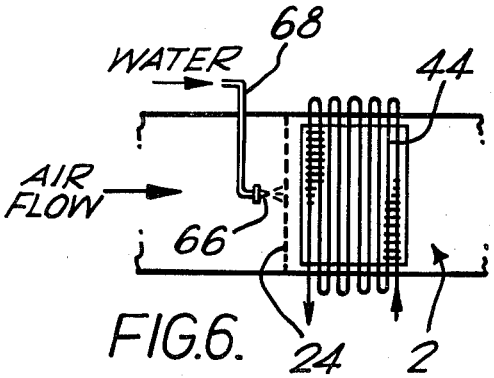
FIG.6.
FIG.7.
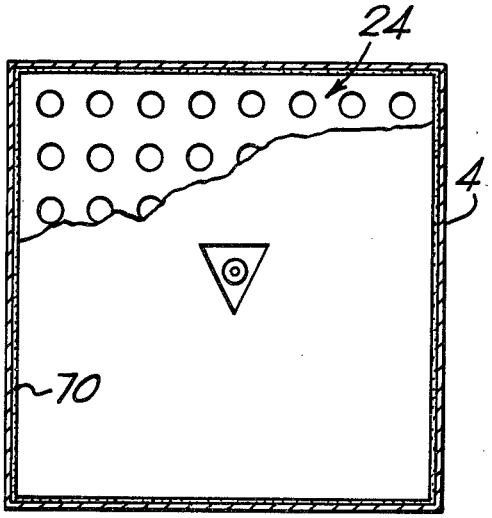

APPARATUS FOR ENSURING HEAT EXCHANGE BETWEEN A GAS FLOW AND A HEAT EXCHANGER

This application is a continuation of application Ser. No. 205,479, filed Nov. 10, 1980 now abandoned.

BACKGROUND OF THE INVENTION

The present invention relates to apparatus for ensuring heat exchange between a gas flow and a heat exchanger.

As energy becomes more expensive it becomes more important to use energy efficiently. In many industrial processes it is necessary to transfer energy between a gas flow and a heat exchanger and it is desirable that this transfer should be as efficient as possible. Furthermore, if more efficient energy transfer can be achieved it becomes economic to recover energy exhausted from industrial processes. For example, the air exhausted from an industrial process or from an air conditioned building may be at a temperature either above or below the ambient temperature and this temperature difference represents energy which it is desirable to reclaim.

Air is supplied to paint spray booths, particularly where water-based paints are used, which is conditioned to a controlled temperature and humidity. This air is then exhausted to atmosphere. Large volumes of air must be conditioned with a consequent expenditure of energy and accordingly it is desirable to recover this energy from the exhaust air.

It has been proposed to pass the exhaust air from a spray booth over heat exchanger coils in which a heat transfer medium flows such that the heat transfer medium is heated or cooled by the exhaust air. For example, in one project the heat exchanger coils contain the condenser fluid from a refrigeration plant and this condenser fluid is cooled by the exhaust air from a paint spray booth.

Of course, the transfer of heat to or from the heat transfer medium in the heat exchanger coils should be as efficient as economically possible.

It is known that where exhaust air is passed over heat exchanger coils the heat transfer rate can be improved by wetting the coils with a liquid. Thus, where the heat transfer medium is to be cooled the liquid on the coils is evaporated and passes into the air flowing over the coils. The evaporation of liquid absorbs heat from the heat exchanger coils.

However, wetting of the coils only significantly increases the efficiency of the heat transfer if the coils are thoroughly wetted.

It is an object of the present invention to provide apparatus for ensuring heat exchange between a gas flow and a heat exchanger in which heat is transferred efficiently.

SUMMARY OF THE PRESENT INVENTION

According to the present invention there is provided apparatus for ensuring heat exchange between a gas flow and a heat exchanger, comprising a duct, means for establishing a flow of gas through the duct, a heat exchanger mounted in the duct, such that the gas flows therethrough, means for spraying liquid within the duct, and means defining constrictions for the gas flow arranged upstream of the heat exchanger in the direction of gas flow such that jets of gas are produced.

The jets of gas created by the constrictions are able to carry liquid into the heat exchanger because of their high velocity and accordingly the surfaces of the heat exchanger are thoroughly wetted. It would be wholly uneconomic to establish the total gas flow through the duct at a sufficiently high velocity to achieve a similar effect because of the power which would be required to establish such a high velocity gas flow.

In an embodiment the constrictions are defined by a diaphragm mounted to extend across the duct and having a plurality of flow passages extending therethrough. The or some of the flow passages may converge in the direction of gas flow to increase the velocity of the jets and to minimise any subsequent flow contraction. Additionally and/or alternately the size of the flow passages may be variable such that the apparatus can be made responsive to changes in the performance required and/or to changes in variables of the system in which the apparatus is incorporated.

In one embodiment, the duct extends vertically and the air is confined to flow upwardly through the duct. A perforated diaphragm extends horizontally across the duct below the heat exchanger. The perimeter of the diaphragm is sealed to the duct. Accordingly, liquid which drains off the duct walls and off the heat exchanger collects over the whole area of the diaphragm. The jets of gas created through the perforations carry liquid collected on the plate into the heat exchanger and it is thereby ensured that the surfaces of the heat exchanger can be reliably wetted by liquid carried from the diaphragm by the gas flow.

The liquid is introduced into the duct by spraying, preferably from one or more nozzles within the duct. Various configurations for the nozzles can be used. For example, one or more nozzles may be disposed beneath the diaphragm and directed upwardly towards the heat exchanger. Appropriate apertures must then be provided in the diaphragm and aligned with the nozzles. Additionally, or alternatively, one or more nozzles may be disposed above the heat exchanger and directed downwardly towards the heat exchanger. The number, configuration and position of the nozzles is chosen in dependence upon the heat transfer rate required, the acceptable gas pressure drop, and the size of the heat exchanger.

In a further embodiment, which is particularly useful for recovering energy from an air flow, the heat exchanger is a coiled tube heat exchanger which is in two sections, a first main section and a second preliminary section. The two sections are mounted in the duct with the main section spaced above the preliminary section. The perforated diaphragm is mounted between the two sections and water spray nozzles are arranged to direct water towards the main section. The perforated diaphragm thus acts to ensure thorough wetting of the main section. If required, additional spray nozzles may direct water onto the preliminary section. It has not been found necessary to provide an additional perforated diaphragm below the preliminary section but such an additional diaphragm could, of course, be provided.

The two coil sections are connected together and are part of a common heat transfer medium circuit. The heat transfer medium flows in the direction opposite to the direction of the air flow in accordance with well-known principles.

BRIEF DESCRIPTION OF THE DRAWINGS

FIG. 2 shows a plan view from above of a second embodiment of a perforated diaphragm in apparatus of the invention, FIG. 3 shows an embodiment of apparatus of the invention showing schematically the circuits for the supply of a heat transfer medium and for the supply of water thereto, FIG. 4 shows a longitudinal section of a further embodiment of apparatus of the present invention, FIG. 5 shows a longitudinal section of a further embodiment of apparatus of the invention, FIG. 6 shows a longitudinal section of a still further embodiment of apparatus of the invention, FIG. 7 shows a plan view of the perforated diaphragm of FIG. 2 showing a different manner of fitting the diaphragm into a duct.

DESCRIPTION OF PREFERRED EMBODIMENTS

Figure 1:
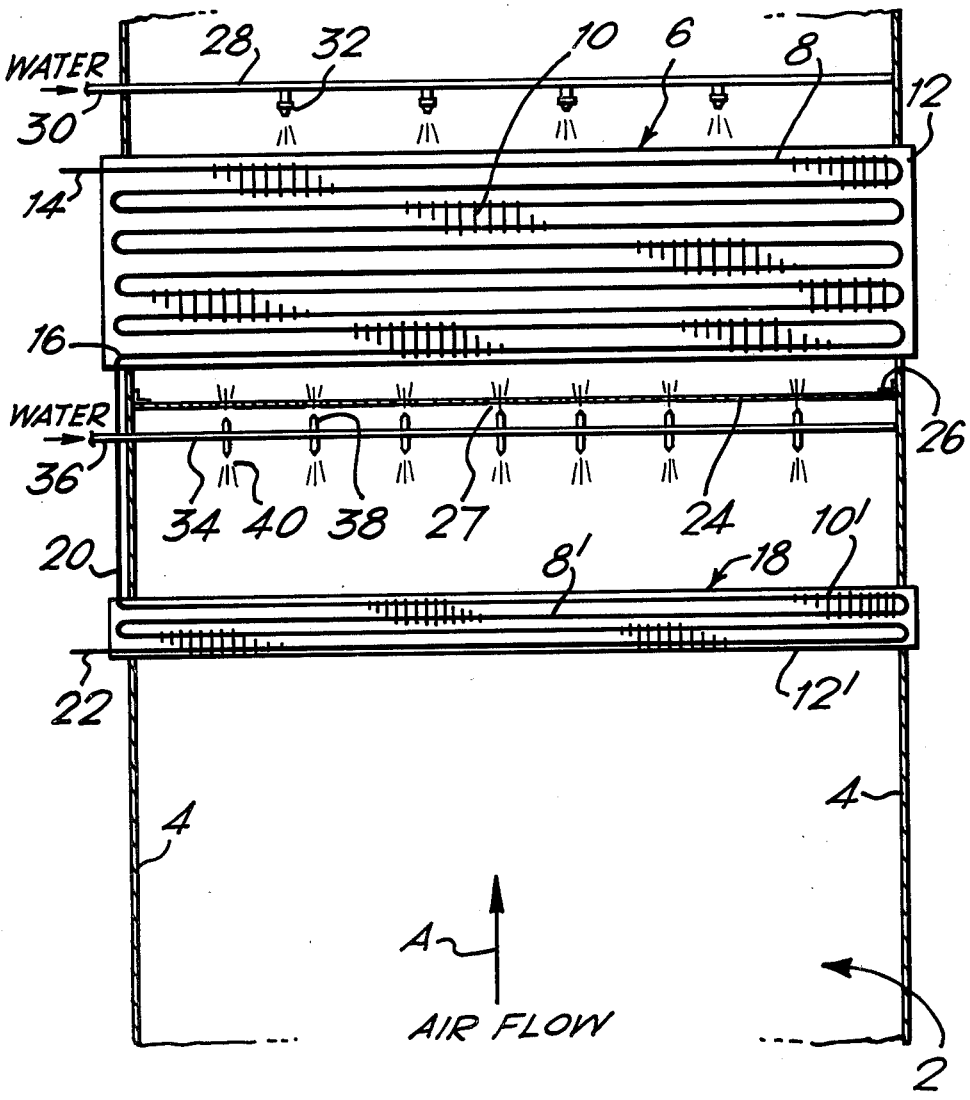
FIG. 1 shows a longitudinal section of a first embodiment of the apparatus of the present invention.

FIG. 1 shows a longitudinal section of apparatus for ensuring heat exchange between a gas flow and a heat exchanger. The apparatus comprises a duct 2 defined by substantially vertically extending walls 4, preferably made of galvanised sheet-metal. The duct 2 has a rectangular cross-section although a duct of any required cross-section may be provided. A main heat exchanger 6 is mounted to extend across the duct 2. This heat exchanger 6 is constructed from a coiled tube 8 and fins 10 are provided on the tube 8 in known manner. The coils of the tube 8 extend through the duct walls 4 and are supported in supports 12 fixed to the outer surface of the wall 4. Hence, the heat exchanger 6 efficiently utilizes the internal area of the duct 2. One end 14 of the tube 8 is the inlet for a heat transfer medium and the other end 16 of the tube 8 is the outlet for the heat transfer medium.

A preliminary heat exchanger 18 is mounted to extend across the duct 2 below and spaced from the main heat exchanger 6. This preliminary heat exchanger 18 is similarly constructed from a coiled tube 8' provided with fins 10' and the coils of the tube 8' extend through the duct walls 4 and are supported in supports 12'. One end 20 of the coiled tube 8' is the inlet for the fluid transfer medium and is connected to the outlet 16 of the main heat exchanger 6. The other end 22 of the coiled tube 8' is the outlet for the heat transfer medium.

A rectangular perforated plate or diaphragm 24 is mounted to extend across the duct 2 between and spaced from the two heat exchangers 6 and 18. The diaphragm 24 is supported by a rectangular angle iron frame 26 fixed to the inner surface of the duct walls 4, for example, by welding. The whole perimeter of the diaphragm 24 is welded or otherwise sealed to the frame 26.

The diaphragm 24 is made of a material and of a thickness such that it is substantially rigid and remains level. For example, the diaphragm may be made of galvanised sheet-metal. If necessary, supports (not shown) may be arranged beneath the diaphragm 24. An array of holes 27 (see FIG. 2) are regularly spaced over the total surface area of the diaphragm 24. Preferably, the holes 27 are sized and spaced such that the holes make up approximately 25% of the surface area of the diaphragm.

A pipe 28 having an inlet 30 extends across the duct 2 above the main heat exchanger 6. A plurality of spray nozzles 32 each facing the heat exchanger 6 are provided on the pipe 28. In addition, a pipe 34 having an inlet 36 extends across the duct 2 below the perforated diaphragm 24. The pipe 34 has a plurality of upwardly directed spray nozzles 38 and a plurality of downwardly directed spray nozzles 40 each of which is aligned with a respective upwardly directed nozzle 38. Each of the nozzles 38 is aligned with a respective aperture 27 in the diaphragm 24.

In use, the duct 2 is arranged such that gas, for example, air from which energy is to be recovered, flows upwardly therethrough as indicated by arrow A. For example, the duct 2 can be connected to receive the exhaust air from a paint spray booth.

Heat transfer medium, for example, glycol, is flowed through the two heat exchangers 6 and 18. The transfer medium enters inlet 14 and flows through the coil 8 to the outlet 16, it subsequently flows into the coil 8' through inlet 20 and then flows out of the outlet 22 after flowing through the coil 8'. Thus, in accordance with well-known principles the heat transfer medium flows in the direction opposite to the direction of the air flow through the duct 2.

It will be appreciated that the heat transfer medium will be either heated or cooled by the air flow and the energy thus imparted thereto can then be used as required. For example, where the exhaust air is cold it can be used to cool the condenser fluid from a refrigerator. This condenser fluid will be the heat transfer medium flowing through the heat exchangers 6 and 18.

It is known that the heat transfer rate can be improved by wetting the coils 6 and 18. Accordingly, in operation a liquid, such as water, is fed to the pipes 28 and 34 such that the nozzles 32, 38 and 40 spray water over the coiled tubes 8 and 8'.

The water sprayed by the nozzles 32 and 38 onto the main heat exchanger 6 will flow over the heat exchanger 6 and the duct walls 4 and will collect on the perforated diaphragm 24. As the air flows through the holes 27 in the diaphragm high velocity jets of air will be created. These jets of air carry water from the plate into the heat exchanger 6 and efficiently wet the surfaces of the coiled tube 8 and fins 10.

In the embodiment shown in FIG. 1 several rows of spray nozzles 32, 38 and 40 are provided. However, various configurations for the nozzles can be provided. For example, one or each row of nozzles could be replaced by an array of nozzles extending transversely across the duct. Alternatively, one or each row of nozzles could be replaced by a single nozzle. In each case, where the nozzles face the heat exchanger 6 and are separated therefrom by the perforated diaphragm 24 suitable apertures must be provided in the diaphragm 24 which are aligned with the nozzles. In FIG. 1, each nozzle 38 extends through one of the holes 27 in the perforated diaphragm 24. However, if required, apertures for the nozzles may additionally be provided in the diaphragm 24.

FIG. 2 shows a plan view of an embodiment of the perforated diaphragm 24 fixed into the duct by an angle iron frame 26 welded to the duct walls 4. The plate 24 shown in FIG. 2 is used where only a single spray nozzle 38' facing upwardly towards the main heat exchanger 6 is provided in place of the row of nozzles 38 shown in FIG. 1. The diaphragm 24 has in addition to the holes 27, a central aperture 42 provided therein and aligned with the nozzle 38'.

FIG. 3 illustrates a further embodiment of the invention and indicates the circuits for the water and the heat transfer medium. In the embodiment shown in FIG. 3 a single heat exchanger 44 is mounted to extend across the duct 2. The heat exchanger 44 is a coiled tube construction and has an inlet 46 and an outlet 48 for the heat transfer medium, for example, glycol. The glycol fed from the heat exchanger 44 is fed to a device 50, for example, a refrigerator condenser, where the energy thereof can be utilized. The glycol is then returned to a reservoir 52 from which it is pumped by pump 54 to the inlet 46.

In the embodiment of FIG. 3 a single nozzle 56 is arranged beneath the perforated diaphragm 24. This nozzle 56, which faces the heat exchanger 44, is connected to receive water from the mains by a pipe 58 including a pump 60.

FIG. 4 shows a further embodiment of the apparatus in which the single coiled tube heat exchanger 44 is mounted to extend across a vertically extending duct 2. The perforated diaphragm 24 is mounted to extend across the duct upstream of the heat exchanger 44 but water is sprayed onto the heat exchanger 44 from a single spray nozzle positioned above the heat exchanger 44 and facing downwardly. It will be appreciated that this embodiment will operate substantially as described above as water flowing downwardly over the heat exchanger 44 will collect on the diaphragm 24 and will then be carried by the jets of air created by the plate 24 into the heat exchanger to efficiently wet the surface thereof.

FIGS. 5 and 6 show further embodiments of the apparatus in which the duct 2 is arranged to extend substantially horizontally. In the embodiment of FIG. 5 an additional, vertically extending duct 64 is connected with the main duct and one or more spray nozzles 66 fed by a pipe 68 are mounted in the additional duct. Accordingly, water is sprayed downwardly over the heat exchanger 44. The perforated diaphragm 24 is mounted to extend across the duct 2 spaced from and upstream of the heat exchanger 44 in the direction of air flow. In this embodiment, water will not collect on the diaphragm 24 but the diaphragm 24 will still create jets of air flowing across the surfaces of the heat exchanger 44. These jets of air will pick up water flowing over the heat exchanger and thereby ensure that the surfaces of the heat exchanger 44 are efficiently wetted.

In the embodiment of FIG. 6 one or more nozzles 66 are arranged upstream of the diaphragm 24 and aligned with apertures therein.

FIG. 7 shows a plan view of the perforated diaphragm 24 which is fitted tightly to the duct walls 4 and fixed thereto, for example, by welding or by the use of a sealant. The joint is then sealed by applying a strip 70 of a waterproof sealant.

In all the embodiments described above, the perforated diaphragm 24 is shown as being provided with a series of equally sized circular holes 27 equidistantly spaced over the whole area of the diaphragm 24. However, it will be appreciated that differently shaped holes, for example, polyhedral holes, may be provided and the size and spacing of the holes may be chosen as required.

Figure 8:
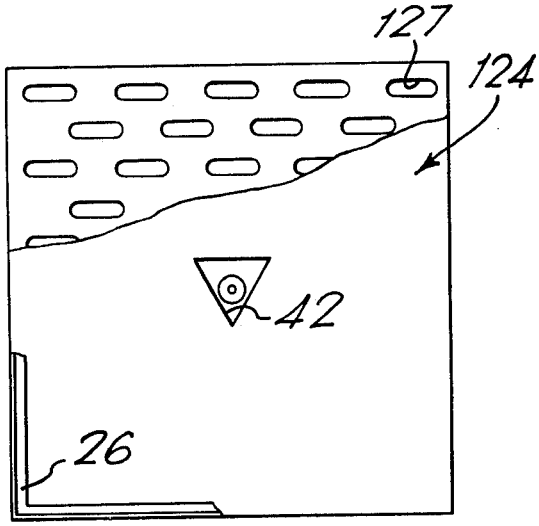
FIG. 8 shows a plan view of a third embodiment of a diaphragm for use in apparatus of the invention.

FIG. 8 shows a plan view of an alternative diaphragm 124 which is perforated by a series of elongate apertures 127.

Figure 9:
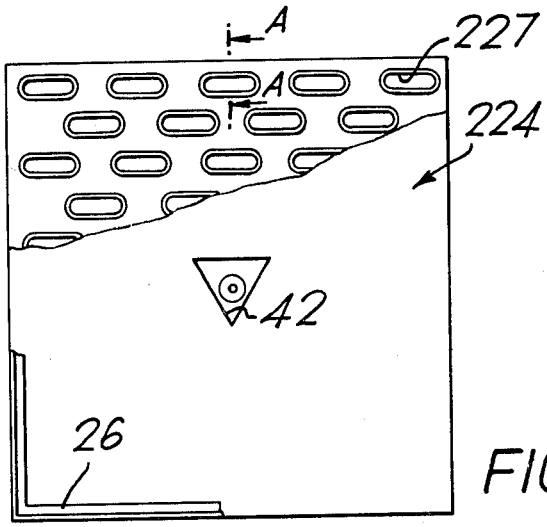
FIG. 9 shows a plan view of a fourth embodiment of a diaphragm.
Figure 9A:
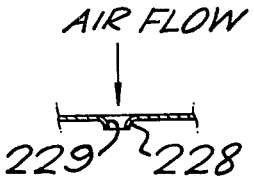
FIG. 9A shows a section of the diaphragm taken on the line AA of FIG. 9.

It will be appreciated that the perforated diaphragm forms means defining constricted flow passages for the air upstream of the heat exchanger such that high velocity jets of air are produced. FIGS. 9 and 9A show a plan view and a section of an alternative diaphragm 224 having a series of elongate orifices 227. Each of the orifices 227 has been pressed from the material of the diaphragm such that a flange 228 extending substantially perpendicular to the plane of the diaphragm 224 has been formed. As is clearly shown in FIG. 9A each flange 228 defines a convergent air flow passage 229. The diaphragm 224 is arranged such that the flow passage 229 converges in the direction of air flow so that a contracting contour is presented to the air flow. The contour is arranged to minimize any flow contraction of the air jets once they have left the flow passages 229.

Figure 10:
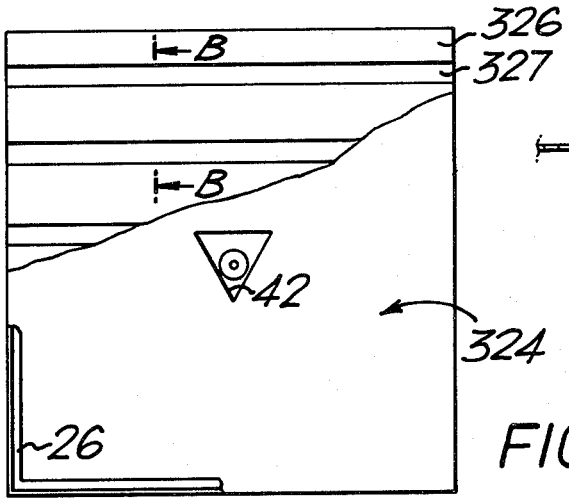
FIG. 10 shows a plan view of a fifth embodiment of a diaphragm.
Figure 10A:
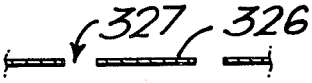
FIG. 10A shows a section of the diaphragm taken on the line BB of FIG. 10.
Figure 11A:
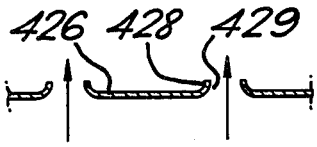
FIG. 11A shows a section of the diaphragm taken on the line CC of FIG. 11.
Figure 11:
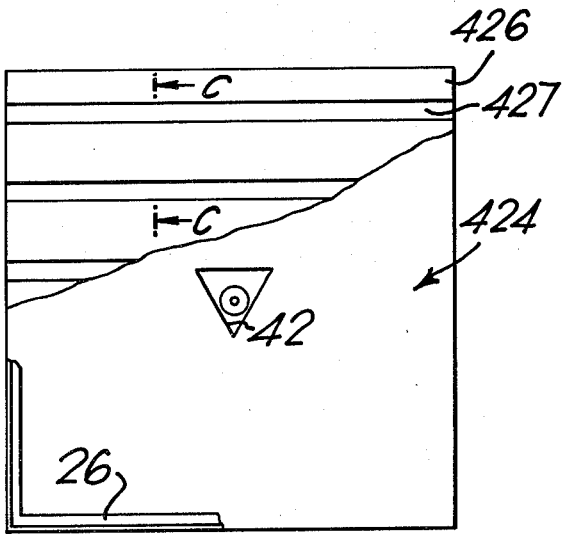
FIG. 11 shows a plan view of a fifth embodiment of a diaphragm.

It has been found that the mechanical strength of the diaphragm can be maintained even if the diaphragm is provided with a number of continuous slots as illustrated in FIGS. 10 and 11. FIGS. 10 and 10A show a plan view and a section of a diaphragm 324 having a number of rigid strips 326 defining slots 327 therebetween. In the embodiment shown in FIG. 10 the longitudinally extending edge of the strips 326 extend within the plane of the diaphragm 324. FIGS. 11 and 11A show a plan view and a section of an alternative diaphragm 424 having slots 427 defined by strips 426. In this embodiment, the longitudinally extending edges of the strips 426 carry flanges 428 extending substantially perpendicular to the plane of the diaphragm 426 and defining convergent flow passages 429. As shown in FIG. 11A the diaphragm 426 is arranged such that the flow passages 429 converge in the direction of air flow.

In each of the embodiments illustrated in FIGS. 10 and 11 the number and width of the strips 326, 426 can be chosen in accordance with the required area of flow passages for the air. These embodiments also enable one or more flow zones to be defined such that air flow can be directed onto one or more selected areas on the face of the heat exchanger. In this manner advantage can be taken of varying temperature differences between the air flow and different areas of the heat exchanger coil.

Figure 12:
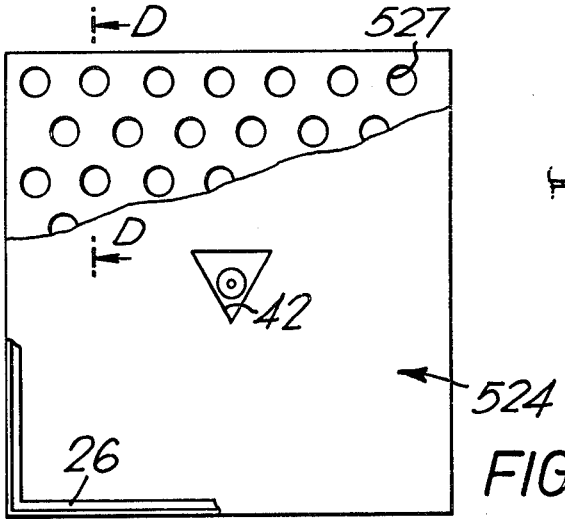
FIG. 12 shows a plan view of a seventh embodiment of a diaphragm.
Figure 12A:
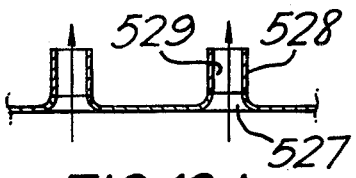
FIG. 12A shows a section of the diaphragm taken on the line DD of FIG. 12.

In the embodiment shown in FIGS. 12 and 12A the diaphragm 524 is provided with a series of circular apertures 527. A cylindrical wall 528 is fixed, for example, by welding, to the edge of each aperture to define elongate flow passages 529 extending perpendicularly relative to the plane of the diaphragm. For optimum results from the apparatus of the invention the diaphragm should be spaced from the heat exchanger by a predetermined distance. For example, where the heat exchanger coil has a cross-sectional area of the order of 2.2 $m^2$ it is preferred that the diaphragm should be spaced therefrom by 100–120 mm. However, it can happen that the normal plane of mounting for the diaphragm is obstructed. In these circumstances the diaphragm 524 can be mounted at a greater spacing from the heat exchanger and the length of the walls 528 chosen such that the free ends thereof lie in a plane situated at the required distance from the heat exchanger.

Figure 13A:
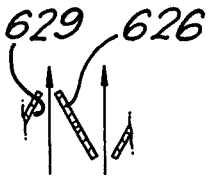
FIG. 13A shows a section of the diaphragm of FIG. 13 taken along the line EE.
Figure 13:
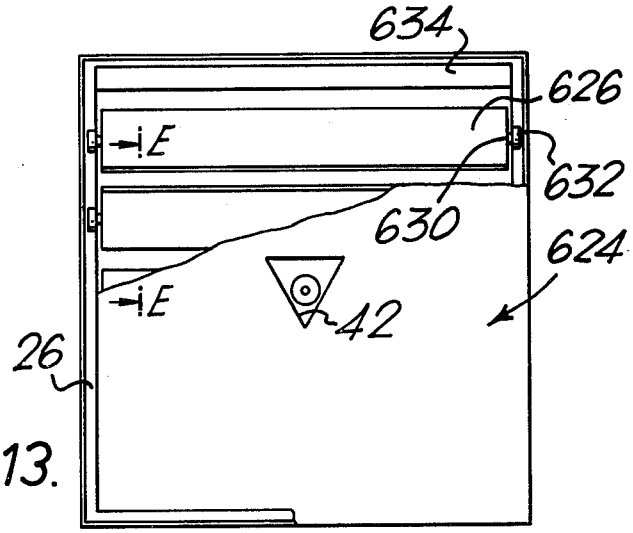
FIG. 13 shows a plan view of a eighth embodiment of a diaphragm having adjustable damper blades.

It may be that the precise performance of apparatus of the invention is not predictable and/or that adjustment of the performance is required in view of variations in other variables in the system. FIGS. 13 and 13A show an embodiment of a diaphragm which can be used to adjustably control the air flow. The diaphragm 624 of FIG. 13 comprises a number of elongate rigid strips 626 extending substantially parallel to each other transversely of the diaphragm 624. A spindle 630 is rigidly attached to each end of each strip 626 and each spindle 630 is pivotable in a respective bearing 632 fixed in the angle frame 26. Thus, the strips 626 form pivotable damper blades. A transversely extending fixed strip 634 is also provided at each end of the diaphragm 624 and is attached to the angle frame 26. The blades are pivoted to project from the plane of the diaphragm such that air flow passages 629 are defined between adjacent strips. Every alternate air flow passage 629 will converge in the direction of the air flow, as can be seen in FIG. 13A, and thus produce high velocity jets of air. Adjustment of the position of the damper blades will adjust the size of the air flow passages and thus the velocity of the jets of air and hence the thermal duty.

Figure 14A:
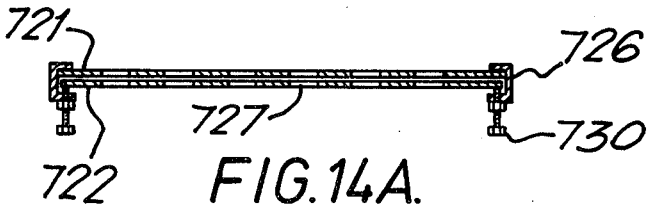
FIG. 14A shows a section of the diaphragm of FIG. 14 taken along the line FF.
Figure 14:
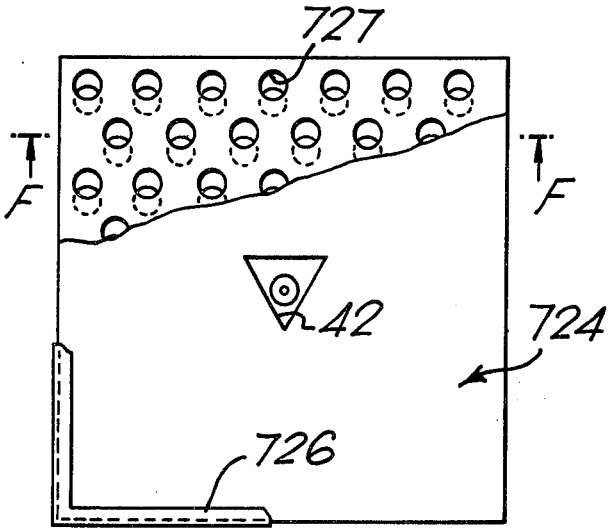
FIG. 14 shows a further embodiment of a diaphragm having flow passages which are adjustable in size.

FIGS. 14 and 14A show a further embodiment of a diaphragm 724 which can be used when variations in the velocity of the jets of air is required. In this embodiment, the diaphragm 724 comprises two plates 721 and 722 mounted one on top of the other. The periphery of each plate 721, 722 is received within a channel section frame 726 which is attached to the duct. The top plate 721 is fixed to the frame 726, whilst the lower plate 722 is supported by the frame 726 so as to be adjustable relative to the top plate 721. Thus, a number of bolts 730 are arranged around the frame 726 for urging the frame 726 into contact with the lower plate 722. Loosening of the bolts 730 enables the position of the lower plate 722 relative to the upper plate 721 to be adjusted, and the lower plate 722 can then be retained in the adjusted position by tightening the bolts 730. Each of the plates 721 and 722 is provided with an array of holes 727 over its area. Preferably, the holes of one plate substantially correspond in both size and distribution to the holes of the other plate. It will be apparent that as the lower plate 722 is moved relative to the top plate 721 the air flow passages defined by the holes 727 will be varied in size.

In the embodiments of the diaphragm illustrated in FIGS. 8 to 14 a central structure 42 is provided therein for alignment with a water spray nozzle. Of course, this central aperture 42 can be omitted and the or each spray nozzle aligned with the apertures or slots provided in the diaphragm. Furthermore, on each of the embodiments shown in FIGS. 8 to 13 the diaphragm is illustrated as being fixed to the duct wall by an angle iron. Of course, other fixing means can be used as required.

I claim:

1. Apparatus for improving heat exchange between a gas flow and the fluid in a heat exchanger in heat transfer relation to said gas flow comprising: a duct defined by longitudinally extending duct walls, means for establishing a flow of gas through the duct, a heat exchanger comprising at least two spaced rows of fluid conduits mounted in the duct and extending transversely to said duct such that the gas flows through each of said rows, at least one spray nozzle arranged to spray liquid within the duct, and a diaphragm mounted within the duct upstream of the heat exchanger in the direction of gas flow, said diaphragm including a rigid plate extending transversely across the duct and having a plurality of perforations therein extending therethrough and defining a plurality of flow passages which extend through said diaphragm and are arranged to define constrictions for the gas flow such that jets of gas are produced, the velocity of said gas jets being sufficient to entrain and carry at least a portion of said liquid through said two rows of fluid conduits.

2. Apparatus according to claim 1, wherein at least one of said flow passages converges in the direction of gas flow.

3. Apparatus according to claim 1, wherein said perforations comprise substantially 25% of the total area of the plate.

4. Apparatus according to claim 1, wherein said diaphragm is spaced from the heat exchanger.

5. Apparatus according to claim 1, wherein the duct is defined by vertically extending walls, the diaphragm is substantially rigid and extends perpendicularly with respect to the walls of the duct, and the perimeter of the diaphragm is sealed with respect to said walls, and wherein said means for establishing a gas flow is arranged to establish a gas flow upwardly toward the duct, said diaphragm being mounted below the heat exchanger.

6. Apparatus according to claim 1, wherein a plurality of spray nozzles are mounted in the duct between the diaphragm and the heat exchanger, at least some of the nozzles being directed towards the heat exchanger.

7. Apparatus according to claim 1, wherein a plurality of spray nozzles are mounted in the duct above the heat exchanger and directed towards the heat exchanger.

8. Apparatus for improving heat exchange between a gas flow and the fluid in a heat exchanger in heat transfer relation to said gas flow comprising: a duct, means for establishing a flow of gas through the duct, a heat exchanger comprising at least two spaced rows of fluid conduits mounted in the duct such that the gas flows through each of said rows, at least one spray nozzle arranged to spray liquid within the duct, and a diaphragm mounted to provide a perforate surface which extends across the duct upstream of the heat exchanger in the direction of gas flow, wherein a plurality of flow passages formed by said perforate surface extend through said diaphragm and are arranged to define constrictions for the gas flow such that jets of gas are produced, the velocity of said gas jets being sufficient to entrain and carry at least a portion of said liquid through said two rows of fluid conduits, the spray nozzle being mounted in the duct below the diaphragm and directed towards the heat exchanger, the diaphragm including an aperture therein aligned with the nozzle.

9. Apparatus for improving heat exchange between a gas flow and the fluid in a heat exchanger in heat transfer relation to said gas flow comprising: a duct, means for establishing a flow of gas through the duct, a heat exchanger comprising at least two spaced rows of fluid conduits mounted in the duct such that the gas flows through each of said rows, at least one spray nozzle arranged to spray liquid within the duct, and a diaphragm having an aperture therein, said diaphragm being mounted to provide a perforate surface which extends across the duct upstream of the heat exchanger in the direction of gas flow, wherein a plurality of flow passages formed by said perforate surface extend through said diaphragm and are arranged to define constrictions for the gas flow such that jets of gas are produced, the velocity of said gas jets being sufficient to entrain and carry at least a portion of said liquid through said two rows of fluid conduits, said spray nozzle being mounted in the duct to extend through said aperture and directed towards the heat exchanger.

10. Apparatus for improving heat exchange between a gas flow and the fluid in a heat exchanger in heat transfer relation to said gas flow comprising: a duct, means for establishing a flow of gas through the duct, a heat exchanger comprising at least two spaced rows of fluid conduits mounted in the duct such that the gas flows through each of said rows, a plurality of spray nozzles arranged to spray liquid within the duct and directed toward the heat exchanger, and a diaphragm mounted to provide a perforate surface which extends across the duct upstream of the heat exchanger in the direction of gas flow, wherein a plurality of flow passages formed by said perforate surface extend through said diaphragm and are arranged to define constrictions for the gas flow such that jets of gas are produced, the velocity of said gas jets being sufficient to entrain and carry at least a portion of said liquid through said two rows of fluid conduits, said diaphragm including a plurality of apertures therein, said apertures being respectively aligned with said spray nozzles.

11. Apparatus for improving heat exchange between a gas flow and the fluid in a heat exchanger in heat transfer relation to said gas flow comprising: a duct, means for establishing a flow of gas through the duct, a heat exchanger comprising at least two spaced rows of fluid conduits mounted in the duct such that the gas flows through each of said rows, at least one spray nozzle arranged to spray liquid within the duct, and a diaphragm provided with an aperture therein and mounted to provide a perforate surface which extends across the duct upstream of the heat exchanger in the direction of gas flow, wherein a plurality of flow passages formed by said perforate surface extend through said diaphragm and are arranged to define constrictions for the gas flow such that jets of gas are produced, the velocity of said gas jets being sufficient to entrain and carry at least a portion of said liquid through said two rows of fluid conduits, said spray nozzle being mounted on the upstream side of the diaphragm and directed towards the heat exchanger, the nozzle being aligned with said aperture.

12. Apparatus for improving heat exchanged between a gas flow and the fluid in a heat exchanger in heat transfer relation to said gas flow comprising: a duct, means for establishing a flow of gas through the duct, a first heat exchanger comprising at least two spaced rows of fluid conduits mounted in the duct such that the gas flows through each of said rows, a first spray nozzle arranged to spray liquid within the duct, a diaphragm mounted to provide a perforate surface which extends across the duct upstream of the first heat exchanger in the direction of gas flow, wherein a plurality of flow passages formed by said perforate surface extend through said diaphragm and are arranged to define constrictions for the gas flow such that jets of gas are produced, the velocity of said gas jets being sufficient to entrain and carry at least a portion of said liquid through said two rows of fluid conduits, a second spray nozzle mounted in the duct and a second heat exchanger mounted in the duct, the first spray nozzle being mounted below the perforated diaphragm and being directed toward one of the heat exchangers, said diaphragm including an aperture therein aligned with the first spray nozzle, the second spray nozzle being mounted below the diaphragm and directed toward the other heat exchanger, said means for establishing gas flow being arranged to establish a gas flow upwardly through the duct such that the perforated diaphragm is upstream of said one heat exchanger.

* * * * *